US006666902B1

(12) United States Patent
Kimura et al.

(10) Patent No.: US 6,666,902 B1
(45) Date of Patent: Dec. 23, 2003

(54) LADLE REFINING APPARATUS AND LADLE REFINING METHOD USING IT

(75) Inventors: Hideaki Kimura, Tokyo (JP); Atsushi Ishikawa, Tokyo (JP); Hiromi Ishii, Muroran (JP); Masayuki Arai, Muroran (JP); Jun Aoki, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/009,963

(22) PCT Filed: May 12, 2000

(86) PCT No.: PCT/JP00/03067

§ 371 (c)(1),
(2), (4) Date: Dec. 14, 2001

(87) PCT Pub. No.: WO01/86007

PCT Pub. Date: Nov. 15, 2001

(51) Int. Cl.[7] ..... C21C 7/10

(52) U.S. Cl. ..... 75/378; 75/386; 75/512; 266/208

(58) Field of Search ..... 75/512, 378, 386; 266/208, 218

(56) References Cited

U.S. PATENT DOCUMENTS 4,604,137 A * 8/1986 Yamada ..... 266/94
5,902,374 A * 5/1999 Kitamura et al. ..... 75/508

FOREIGN PATENT DOCUMENTS

| | | |
|---|---|---|
| JP | 2-6158 | 1/1990 |
| JP | 4-56715 | 2/1992 |
| JP | 404308025 | * 10/1992 |
| JP | 9-111331 | 4/1997 |
| JP | 2000-178637 | 6/2000 |

OTHER PUBLICATIONS

Patent Abstracts of Japan, for JP 02–006158, published Jan.–1990. Two pages.*

* cited by examiner

*Primary Examiner*—Melvyn Andrews
(74) *Attorney, Agent, or Firm*—Wenderoth, Lind & Ponack, L.L.P.

(57) ABSTRACT

The present invention provides a lade refining apparatus capable of suppressing skull deposition in a vacuum/decompression chamber and performing molten steel agitation, slag reforming and degassing efficiently, and a ladle refining method using the apparatus. The apparatus includes a vacuum/decompression chamber directly coupled to a top of a ladle, and is designed to have inert gas blown into the ladle for agitation of molten steel in the ladle. An inner diameter of a shaft of the vacuum/decompression chamber is not larger than an inner diameter of a top end of the ladle, but not smaller than a projected diameter of a bulging portion of a molten steel surface formed by the gas blown into the ladle.

26 Claims, 5 Drawing Sheets

LADLE REFINING APPARATUS AND LADLE REFINING METHOD USING IT

TECHNICAL FIELD

The present invention relates to an apparatus for and a method of ladle refining which is a secondary refining process of molten steel.

BACKGROUND ART

Quality demands for steel products have lately become more and more stringent as steel application technologies have advanced and diversified and, as a consequence, needs for production of high purity steels have further increased. In response to the needs for high purity steel production, many apparatuses for hot metal pretreatment and secondary refining have been newly constructed at steelmaking plants. As apparatuses for secondary refining in particular, vacuum refining apparatuses such as RH, DH, and the like, and electric arc-heating slag refining apparatuses typically such as LF are commonly used for purposes of degassing and inclusion removal of molten steel. For producing high purity steels such as bearing steels, treatment processes combining the LF, RH, and the like, as needed, are also commonly practiced.

However, there is a certain limit to refining capacity for removing inclusions in case of an apparatus such as an RH vacuum refining apparatus, wherein a vacuum refining treatment is performed by inserting an immersion tube into molten steel in a ladle and sucking up the molten steel into a vacuum chamber through the immersion tube, because: slag is not sufficiently reformed since a force to agitate the molten steel in the ladle is weak and the slag on a molten steel surface outside the immersion tube is not sufficiently agitated, and, as a result, the molten steel is re-oxidized by highly oxidizing slag; and the molten steel is re-oxidized also by a reaction between iron oxides contained in skulls deposited in the vacuum chamber and the molten steel in the vacuum chamber. Methods to lower an oxidizing capacity of slag by a combined use of an LF apparatus and the like are commonly practiced for the purpose of preventing steel re-oxidatipn by the slag and consequent deterioration of purity of molten steel. But these methods have problems of protracted processing time and increased production costs caused by greater heat loss, wear of refractories, etc. resulting from a long processing time.

In view of these problems, as measures of conventional technologies to effectively accelerate reaction between slag and molten steel under a vacuum by directly reducing atmospheric pressure on the molten steel surface in a ladle, a VOD process, a VAD process, an SS-VOD process and the like have been developed. As methods to directly reduce atmospheric pressure on the molten steel surface in a ladle, there are a method to expose the ladle in its entirety to a reduced atmospheric pressure by placing the ladle inside a decompression vessel capable of accommodating the entire ladle, and another method to reduce atmospheric pressure on the molten steel surface in a ladle by using the ladle itself as a lower decompression chamber and having an upper decompression chamber tightly coupled to a top of the ladle. Both methods have problems in that the equipment is complicated and that, owing to their structural restrictions, it is impossible to inject a great amount of agitation gas for preventing molten steel or slag from splashing. Thus, these methods have not been widely used for reasons of productivity, equipment cost and maintenance.

From the above viewpoints, as an invention to improve a method of exposing an entire ladle to a reduced atmospheric pressure by placing the ladle inside a vacuum/decompression vessel capable of accommodating the entire ladle, Japanese Unexamined Patent Publication No. H9-111331 discloses a method capable of coping with molten steel splashing and slag foaming during vacuum processing and reducing a processing time by installing an inner tube having a sufficiently large free board inside a vacuum chamber. However, this method is a method to refine steel by placing an entire ladle inside a vacuum chamber which is divided into upper and lower sections and whose inner diameter is larger than an outer diameter of a top end of the ladle, and uses facilities such configured so that a lower end of the inner tube is tightly coupled to a top end of the ladle, or is immersed in slag and molten steel in the ladle. For this reason, it is feared that, during vacuum refining, attachment and/or detachment of the inner tube to/from the ladle may become impossible owing to skulls caused by splashes of the molten steel, or the molten steel is contaminated by the skulls in the case that the inner tube is immersed in the molten steel in the ladle. Further, this method has another problem of difficulty in securing a temperature of molten steel when processing time is prolonged.

As a method to reduce atmospheric pressure on a molten steel surface in a ladle by using the ladle itself as a lower decompression chamber, and tightly coupling an upper decompression chamber to atop of the ladle, disclosed in Current Advances in Materials and Processes, Vol. 3, No. 1, 1990, p250 (published by the Iron and Steel Institute of Japan) is a method to prevent splashes generated on the molten steel surface by gas injected through a ladle bottom from directly contacting a coupling portion (ladle sealing portion) between the ladle and the upper decompression chamber by installing an inner lid at an upper part of the ladle, and to prevent splashes from flying over the inner lid and contacting the ladle sealing portion by installing a shielding board at the upper part of the ladle. This method, however, has problems in that the attachment and/or detachment of the inner lid may be rendered impossible by skulls formed by the molten steel splashes and that a refractory cost of the shielding board itself becomes significant since the molten steel splashes also adhere to it. Further, there is another problem in that workability is poor because the inner lid and the shielding board have to be attached and detached at every vacuum treatment cycle.

SUMMARY OF THE INVENTION

The present invention provides a ladle refining apparatus capable of easily solving the problems of the conventional technologies, and a ladle refining method using the apparatus. The present invention is, namely, an apparatus for and a method of ladle refining capable of efficiently producing high purity steels and significantly improving thermal tolerance by: radically improving operational difficulties and contamination of molten steel, which have constituted the problems of conventional ladle refining methods, through suppressing skull deposition caused by splashing of molten steel; and, at the same time, performing molten steel agitation, slag reforming and degassing efficiently.

The present invention is a vacuum/decompression refining apparatus to refine molten steel in a ladle by directly coupling a vacuum/decompression chamber 2, not having at its lower end an immersion tube to be immersed into molten steel 4 in a ladle 1, to an upper part of the ladle and reducing internal pressure of the vacuum/decompression chamber, and by agitating the molten steel in the ladle through injection of inert gas into the ladle. The apparatus is characterized in that: the upper part of the ladle is tightly coupled to the vacuum/decompression chamber to form a sealed structure; the vacuum/decompression chamber has a shaft portion; an inner diameter of the shaft portion is smaller than an inner diameter of a top end of the ladle but not smaller than the projected diameter of a bulging portion 7 of the molten steel surface in the ladle formed by agitation gas injected into the ladle; and a height from a surface of the molten steel in the ladle to a top of the vacuum/decompression chamber is 5 m or more.

Further, the present invention is a vacuum/decompression apparatus characterized in that: a lower end of vacuum/decompression chamber 2 is provided with a cylindrical appendage 9. The cylindrical appendage has an inner diameter equal to or larger than a projected diameter of a bulging portion of molten steel in ladle 1, and an outer diameter equal to or smaller than the inner diameter of the top end of the ladle. Also, a lower end of the cylindrical appendage extends lower than a top of the ladle but is not immersed in the molten steel in the ladle.

Furthermore, the present invention is a vacuum/decompression apparatus capable of heating molten steel 4 and maintaining a temperature in a vacuum/decompression chamber by installing a burner 10, which discharges flame from its lower end, by burning fuel and oxygen gas, inside vacuum/decompression chamber 2. The present invention is, further, a steel refining method using the aforementioned vacuum/decompression apparatus, characterized by constantly maintaining a temperature of an inner wall of the vacuum/decompression chamber at 1,000° C. or higher, during continuous operations, by the flame discharged from the lower end of the heating burner 10.

Yet further, the present invention is a ladle refining method characterized by refining molten steel, when using the vacuum refining apparatus, in a manner that an amount of slag on a surface of the molten steel in the ladle satisfies the following expression:

$$0.010 \leqq H/h \leqq 0.025,$$

where, H is a thickness of the slag in the ladle and h is a depth of a molten steel bath in the ladle.

In addition, the present invention is a ladle refining method characterized by controlling pressure in a vacuum/decompression chamber to 760 to 500 Torr when heating molten steel by adding Al to molten steel and burning the added Al by supplying oxygen gas.

Explanation of Reference Numerals

Figure 1:
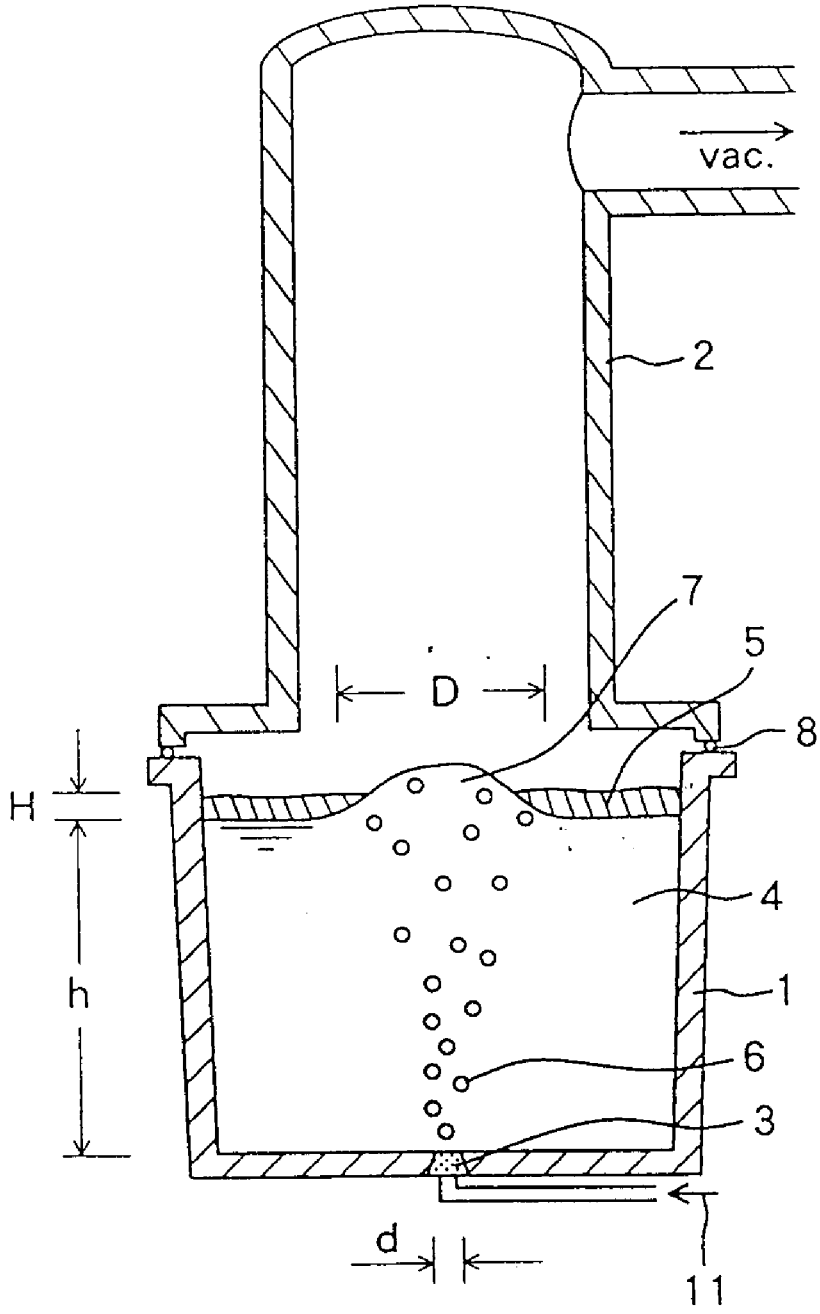
FIG. 1 is a sectional view of an example of an apparatus according to the present invention.

1 Ladle
2 Vacuum/decompression chamber
3 Agitation gas injection plug
4 Molten steel
5 Slag
6 Agitation gas
7 Bulging portion of molten steel surface formed by agitation gas
8 Sealing material
9 Cylindrical appendage
10 Heating burner

DESCRIPTION OF THE PREFERRED EMBODIMENTS

Examples of the present invention are explained in detail hereafter based on the drawings. FIG. 1 shows an embodiment of a ladle refining apparatus according to the present invention. The apparatus is composed of a ladle 1 and a vacuum/decompression chamber 2, and the ladle is equipped with an agitation gas injection apparatus 3 centrally located at its bottom. The injection apparatus 3 is designed to inject an inert gas into the ladle 1 from an upper surface of the injection apparatus. The present invention does not specify a method of agitation of molten steel 4 in the ladle. The vacuum/decompression chamber is so constructed that its inner diameter at a shaft is smaller than its inner diameter of a top end of the ladle but not smaller than a projected diameter D of bulging portion 7 of a molten steel surface in the ladle. The projected diameter of the bulging portion of the molten steel surface formed when an agitation gas is injected from the bottom of the ladle can be calculated from the equation given below.

$$D = d + 2h \cdot \tan 12^\circ,$$

where, D is the projected diameter of the bulging portion of the molten steel surface, d is the diameter of a gas injection plug, and h is the depth of a molten steel bath in the ladle.

An upper portion of the ladle and the vacuum/decompression chamber are tightly coupled together and a sealing structure capable of maintaining a desired degree of vacuum is provided between the ladle and the vacuum/decompression chamber. The molten steel is stirred by injecting agitation gas 6 from the bottom of the ladle while an inside of the vacuum/decompression chamber is kept at normal atmospheric pressure or in a vacuum. The molten steel surface bulges upwardly under a high vacuum and the molten steel and slag 5 splash upwardly. By an apparatus according to the present invention, however, adverse effects of the splashing of the molten steel and the slag to the sealing between the ladle and the vacuum/decompression chamber, which effects constitute a problem of the conventional VOD process, can be minimized, because the inner diameter of the shaft of the vacuum/decompression chamber is smaller than the inner diameter of the top end of the ladle. The molten steel and the slag splash upwardly from the bulging portion 7 of the molten steel surface, then turn downwardly to hit the sealing portion of the ladle. However, by the present invention, because there exists a shaft of the vacuum/decompression chamber having an inner diameter smaller than the inner diameter of the top end of the ladle on an upper portion of the ladle, splashes of molten steel and slag flying upwardly hit the inner surface of the shaft of the vacuum/decompression chamber and fall directly to the molten steel surface in the ladle, and thus the splashes of molten steel and slag do not reach the sealing portion of the ladle. Furthermore, in the case that a shielding board is used, most of the splashes of molten steel and slag hit the shielding board and portions of these splashes deposit and solidify on its surface to form skulls. However, since the present invention does not use a shielding board, this does not happen. When the vacuum/decompression chamber has a small inner diameter, it is easier to keep its inner surface at a high temperature and, consequently, a rate of solidification of the splashes of the molten steel and slag to form skulls, in the shaft of the vacuum/decompression chamber can be made very slow and, as a result, yield loss can be minimized. Thanks to the small diameter of the shaft of the vacuum/decompression chamber, vacuum evacuation volume is small and an initial evacuation time to attain a vacuum can be shortened. In addition, the present invention does not involve troublesome work and cost increase of installation, removal, and the like, of a shielding board. The reason why the inner diameter of the shaft of the vacuum/decompression chamber is specified as being equal to or larger than the projected diameter of the bulging portion of the molten steel surface is that splashes of the molten steel and slag originate for the most part from the bulging portion of the molten steel surface.

Figure 2:
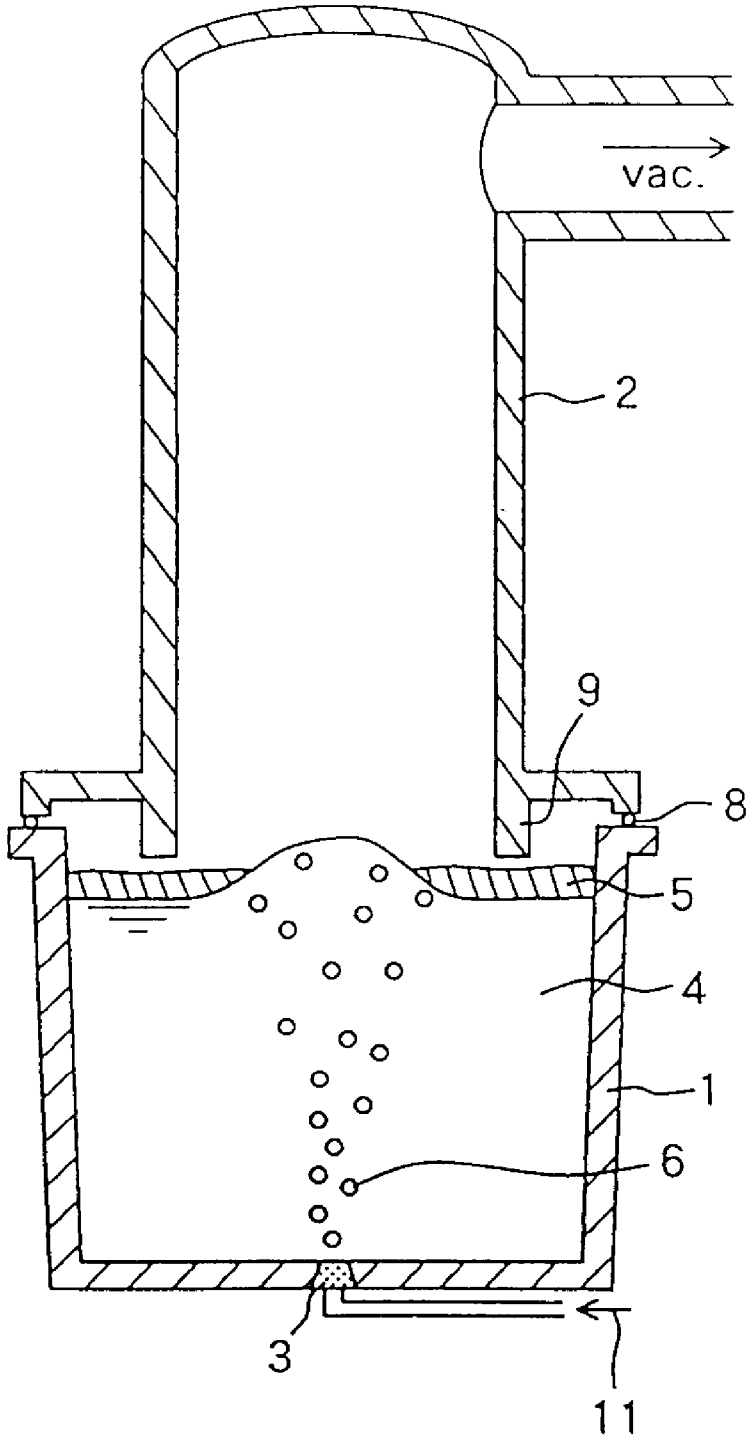
FIG. 2 is a sectional view of an apparatus according to the present invention in a case that a cylindrical appendage is mounted inside a vacuum lid of the apparatus.

FIG. 2 shows an example wherein a cylindrical appendage 9 is mounted at the bottom of the vacuum/decompression chamber in a manner that its lower end is lower than the top end of the ladle but not immersed in the molten steel 4 and the slag 5 in the ladle. The cylindrical appendage 9 has an inner diameter equal to or larger than the projected diameter of the bulging portion 7 of the molten steel in the ladle and an outer diameter equal to or smaller than the inner diameter of the top end of the ladle, and is constructed by using refractories or by covering the surface of a metal core with refractories. When the cylindrical appendage 9 is mounted, the adverse effects of the splashing of the molten steel and the slag to the sealing portion between the ladle and the vacuum/decompression chamber can further be reduced than the case shown in FIG. 1. Advantages of the cylindrical appendage include, additionally, improvement of productivity (t/CH) by reduction of the free board volume of the ladle, and further enhancement in refining efficiency by increasing an amount of gas injected into the molten steel. The reason why the cylindrical appendage 9 is not immersed in the slag 5 or the molten steel 4 is that it is enough for obtaining a sufficient effect if the lower end of the cylindrical appendage is at a level equal to or lower than the top end of the ladle and that, when it is immersed in the slag or the molten steel, costs for the refractories will increase. Additionally, from a viewpoint of producing high purity steels, it is desirable to stir the slag in its entirety on the surface of the molten steel in the ladle so that the slag 5 and the molten steel 4 may fully react to reform the slag. In this respect, the non-immersion design is more advantageous because, in case of an immersion design, an agitation force outside the immersed cylindrical appendage becomes weak and slag reforming also becomes insufficient.

The present invention does not specify a sealing method of the joint between a ladle 1 and the vacuum/decompression chamber 2. It is, however, desirable to use a sealing material that is excellent in heat resistance such as asbestos, metal Al, or the like, in consideration of heat resistance in the event that the free board height of the ladle is insufficient and, the molten steel and the slag in the ladle overflow to the sealing portion, or the like. If a rubber-based sealing material is used, it is preferable to take a measure for enhancing heat resistance, such as mounting a double seal containing asbestos on a side of the ladle. The present invention does not specify a position of the sealing material to be at the top of the ladle. The sealing material may be located outside the ladle and a little below its top end and may be structured so that the sealing material is not directly exposed to radiation heat from the molten steel. The present invention also includes such sealing structures.

It is preferable that the vacuum/decompression chamber 2 has a sufficient height to be clear of splashes of the molten steel and the slag during vacuum processing and, from this viewpoint, the present invention specifies the height of the vacuum/decompression chamber as 5 m or more. If the height is less than 5 m, skulls may deposit on the ceiling of the vacuum/decompression chamber, the shaft of the vacuum/decompression chamber may be clogged and/or the skulls may enter into the vacuum evacuation duct, resulting in drastic deterioration of production efficiency and increase in equipment maintenance costs. No upper limit of the vacuum/decompression chamber height is specifically set forth, but attention must be paid not to make the vacuum/decompression chamber too tall, because an initial evacuation time will become too long as a result of a large evacuation volume when the height is too large.

Figure 3:
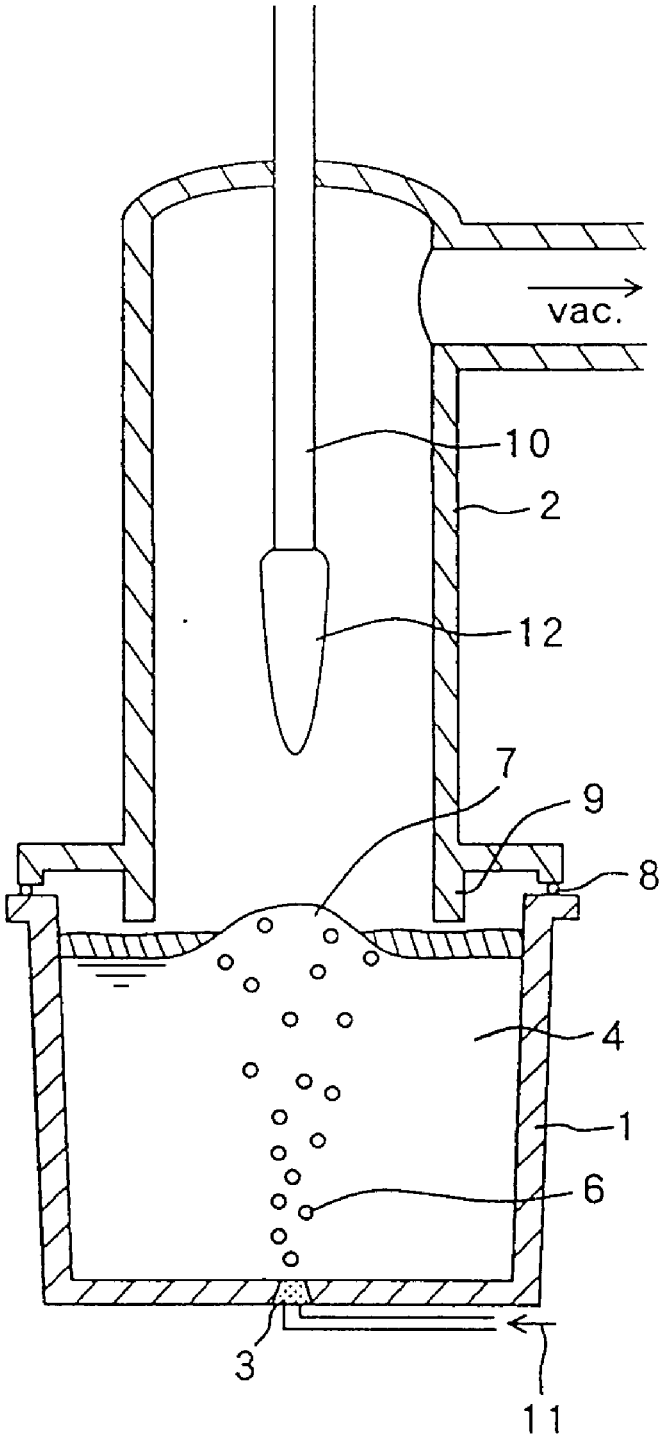
FIG. 3 is a sectional view of an apparatus according to the present invention in a case that a heating burner is installed therein.

FIG. 3 shows an example in which a heating burner 10 for blowing and burning fuel gas and oxygen gas is mounted inside the vacuum/decompression chamber. The heating burner 10 heats refractories inside the vacuum/decompression chamber and keeps the refractories inside the chamber at a high temperature all the time during processing and non-processing. This suppresses skull deposition on the refractories inside the chamber more effectively, prevents contamination of molten steel caused by the skull deposition, consequently relaxes restrictions on continuous processing of different steel grades, and avoids the deterioration of productivity as a result of skull removing work. For obtaining a sufficient effect on preventing skull deposition, it is essential to keep a temperature of the refractories on an inner wall of the chamber always at 1,000° C. or higher. A temperature drop of molten steel during processing can be decreased by heating the interior of the vacuum/decompression chamber with the heating burner constantly at a high temperature during processing and non-processing.

Efficient refining operation is realized by controlling an amount of slag on the molten steel surface in the ladle within the range specified below during refining using an apparatus according to the present invention.

$$0.010 \leqq H/h \leqq 0.025,$$

where, H is thickness of the slag in the ladle and h is depth of the molten steel bath in the ladle.

The reason why the range of H/h is limited as above is as follows. When slag is thick and the value of H/h is equal to or larger than 0.025, a molten steel surface is covered with the slag even during vacuum refining, and an area of the molten steel surface exposed to the vacuum becomes so small that a sufficiently high dehydrogenation efficiency cannot be achieved. When slag thickness is small and the value of H/h is 0.010 or smaller, on the other hand, a contact surface between molten steel and slag becomes too small and inclusion adsorption capacity of the slag deteriorates, resulting in an insufficient deoxidation efficiency. It is therefore preferable to control the slag thickness within the above range when refining high purity steels.

By an apparatus according to the present invention, it is also possible to supply only oxygen through the heating burner 10 mounted on the upper part of the vacuum decompression chamber, bum Al contained in molten steel, and heat the molten steel by the heat of a combustion reaction. In this regard, by the conventional RH oxygen top blowing method, pressure inside the reaction vessel has to be 200 Torr or lower in order to suck up molten steel into the vessel, and for this reason, the oxygen gas whose volume expands under the reduced pressure splashes the molten steel, or so does the CO gas formed through the reaction between oxygen and carbon in the molten steel. Therefore, violent generation of splashes has been a serious problem of the conventional RH oxygen top blowing method. By an apparatus according to the present invention, in contrast, it is enough if pressure in the chamber during treatment of supplying oxygen in molten steel is normal atmospheric pressure or lower. Therefore, it is possible to minimize occurrence of splashes by conducting Al combustion heating of the molten steel with oxygen top blowing under a chamber pressure of 500 Torr or more and 760 Torr or less. The reason why pressure in the vacuum/decompression chamber is specified as 760 Torr or less is that, when the vacuum/decompression chamber is pressurized more than normal atmospheric pressure, burnout of the sealing material occurs caused by blowout of high temperature gas in the vacuum/decompression chamber to the vacuum sealing joint.

Note that an apparatus according to the present invention may be equipped, as needed, with a wire feeder to feed an element having a high vapor pressure such as Ca, wrapped in a steel cover in the form of a wire. It is preferable that such a wire feeding operation be conducted under the normal atmospheric pressure subsequent to a refining process under a vacuum/decompression.

EXAMPLE

Molten steel was decarburized in a converter, and then 6.8 kg/t of a Mn alloy, 2.7 kg/t of a Si alloy, each in terms of pure alloy content, and 0.45 kg/t of Al were added to the molten steel at a tapping from the converter. 3.0 kg/t of CaO was also added to the molten steel for the purpose of controlling composition of slag. The molten steel thus prepared was then refined using an apparatus according to the present invention as shown in FIG. 3. Results of the above processing were compared with those obtained through the conventional RH method. Table 1 shows production conditions and results of the example of the present invention, and Table 2 those of the comparative example.

TABLE 1

| Example of the present invention | | | | | | | |
|---|---|---|---|---|---|---|---|
| Steel grade | S45C | | | | | | |
| Molten steel amount | 280 t | | | | | | |
| Depth of molten steel bath | 3,720 mm | | | | | | |
| Attained degree of vacuum | 0.6 Torr | | | | | | |
| Evacuation treatment time | 21 min. | | | | | | |
| Ar gas flow rate | 30 $Nm^3$/hr. (ladle bottom blown gas) | | | | | | |
| Before processing | | | | | | | |
| Molten steel chemical composition | C 0.30% | Si 0.19% | Mn 0.73% | P 0.008% | S 0.013% | H 3.5 ppm | O 35 ppm |
| Slag composition | T.Fe 1.26% | CaO 44.59% | $SiO_2$ 14.02% | $Al_2O_3$ 26.51% | MnO 0.73% | MgO 5.02% | S 0.08% |
| Slag thickness | 60 mm | | | | | | |
| Temperature | 1,575° C. | | | | | | |
| After processing | | | | | | | |
| Molten steel chemical composition | C 0.44% | Si 0.20% | Mn 0.75% | P 0.008% | S 0.020% | H 1.1 ppm | O 8 ppm |
| Slag composition | T.Fe 0.24% | CaO 40.12% | $SiO_2$ 4.35% | $Al_2O_3$ 38.65% | MnO 0.21% | MgO 6.52% | S 1.54% |
| Slag thickness | 70 mm | | | | | | |
| Temperature | 1,553° C. | | | | | | |

TABLE 2

| Example of conventional RH process | |
|---|---|
| Steel grade | S45C |
| Molten steel amount | 278 t |
| Depth of molten steel bath | 3,700 mm |
| Attained degree of vacuum | 0.6 Torr |
| Evacuation treatment time | 23 min. |
| Ar gas flow rate | 110 $Nm^3$/hr. (RH recirculation gas) |

TABLE 2-continued

| Example of conventional RH process | | | | | | | |
|---|---|---|---|---|---|---|---|
| Before processing | | | | | | | |
| Molten steel chemical composition | C 0.29% | Si 0.18% | Mn 0.73% | P 0.007% | S 0.020% | H 3.6 ppm | O 31 ppm |
| Slag composition | T.Fe 1.54% | CaO 42.18% | $SiO_2$ 13.97% | $Al_2O_3$ 28.49% | MnO 0.80% | MgO 4.87% | S 0.08% |
| Slag thickness | | | | 60 mm | | | |
| Temperature | | | | 1,585° C. | | | |
| After processing | | | | | | | |
| Molten steel chemical composition | C 0.45% | Si 0.19% | Mn 0.76% | P 0.007% | S 0.016% | H 1.2 ppm | O 18 ppm |
| Slag composition | T.Fe 1.40% | CaO 38.38% | $SiO_2$ 14.08% | $Al_2O_3$ 31.36% | MnO 1.10% | MgO 4.75% | S 0.09% |
| Slag thickness | | | | 60 mm | | | |
| Temperature | | | | 1,550° C. | | | |

Hydrogen content after processing in the example of the invention was nearly the same as that in the comparative example, and both hydrogen contents were good. On the other hand, whereas oxygen content after processing in the comparative example was 18 ppm, that in the example of the invention was as very good as 8 ppm. While the total amount of iron in the slag composition after processing was as high as 1.40% in the comparative example, that in the example of the invention was reduced to a very low figure of 0.24% as a result of a sufficiently advanced reaction between the slag and the molten steel in the ladle. For this reason, an oxidizing capacity of the slag was lowered and oxygen concentration of the molten steel could decrease in the example of the invention. As seen in the above, use of an apparatus according to the present invention makes it possible to attain a low hydrogen content level as compared to that attainable by the conventional RH process, and obtain a steel having higher purity than that obtainable by the conventional method.

Figure 4:
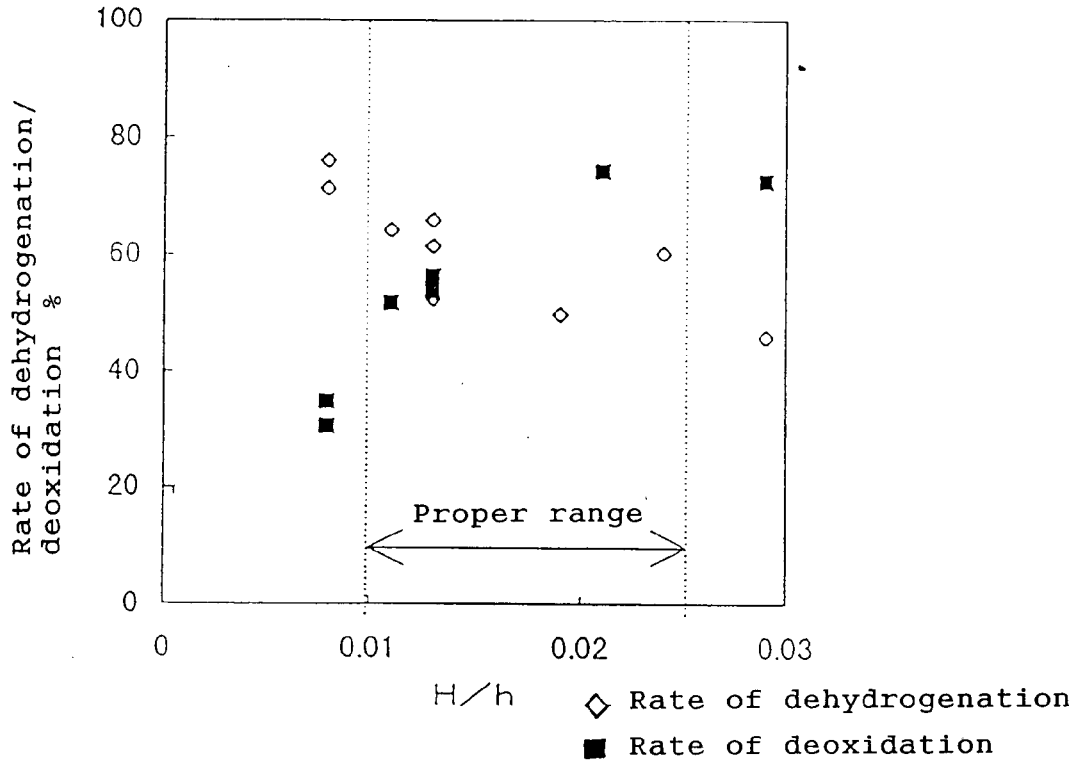
FIG. 4 is a graph showing a relationship between a ratio (H/h) of a thickness H of slag in a ladle to a depth h of a molten steel bath and various refining efficiency figures when molten steel is refined using an apparatus according to the present invention.

FIG. 4 is a graph showing a relationship between the ratio (H/h) of the slag thickness H in the ladle to the depth h of the molten steel bath, and efficiency of dehydrogenation and deoxidation during vacuum refining using an apparatus according to the present invention. In a zone where the value of H/h is larger than 0.025, the molten steel surface is covered with slag even during vacuum processing and the area of the molten steel surface exposed to the vacuum is small and, as a result, a sufficiently high dehydrogenation efficiency is not achieved. In a zone where the value of H/h is smaller than 0.010, on the other hand, the amount of slag is too little to secure a sufficient reaction area between the slag and the molten steel and, as a consequence, a good deoxidation efficiency steel is not attained.

Figure 5:
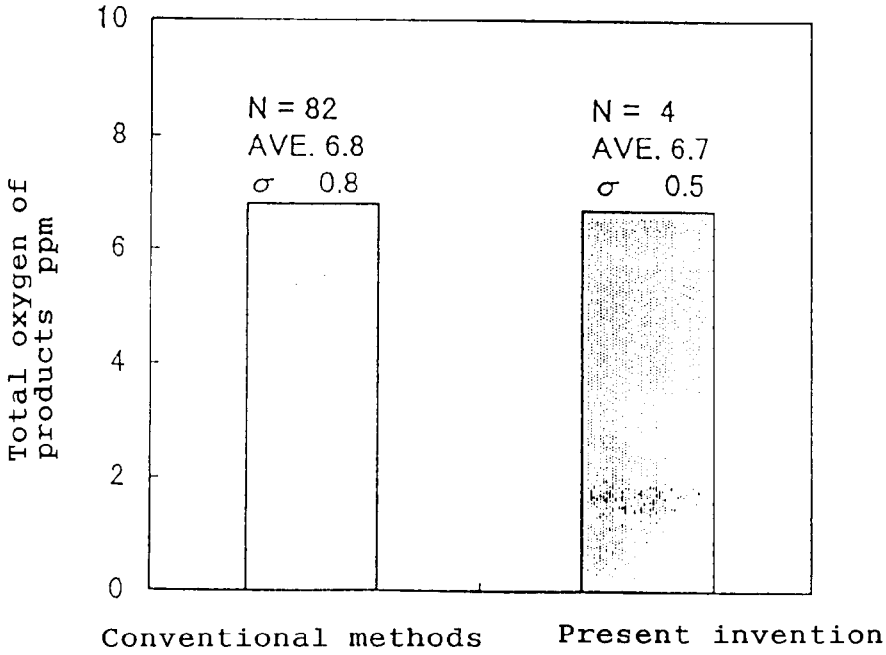
FIG. 5 is a graph comparing a conventional method and a method according to the present invention with respect to total oxygen of bearing steel products.

Total oxygen of bearing steel products is shown in FIG. 5, comparing the result obtained through refining using an apparatus according to the present invention with that obtained through refining by performing the LF-RH method, which has conventionally been used for producing high purity steels. Use of an apparatus according to the present invention makes it possible to attain high purity equal to or better than that conventionally achievable and reduce production costs by elimination of the LF process even when producing high grade steels such as bearing steels.

Figure 6:
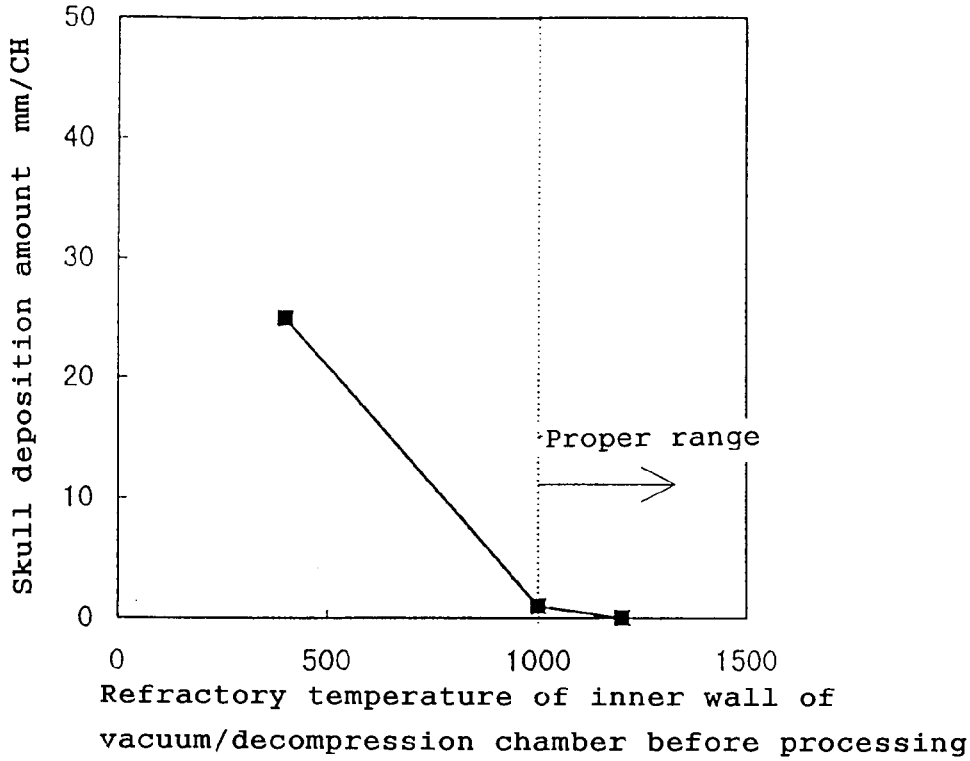
FIG. 6 is a graph showing a relationship between a temperature of an inner refractory wall of a vacuum/decompression chamber of an apparatus according to the present invention and thickness of skulls deposited on a refractory surface.

FIG. 6 shows an effect of the heating burner of the vacuum/decompression chamber regarding the apparatus shown in FIG. 3. An amount of skull deposition can remarkably be reduced by keeping temperature of refractories on the inner wall of the vacuum/decompression chamber at 1,000° C. or higher using the heating burner in the vacuum/decompression chamber.

Figure 7:
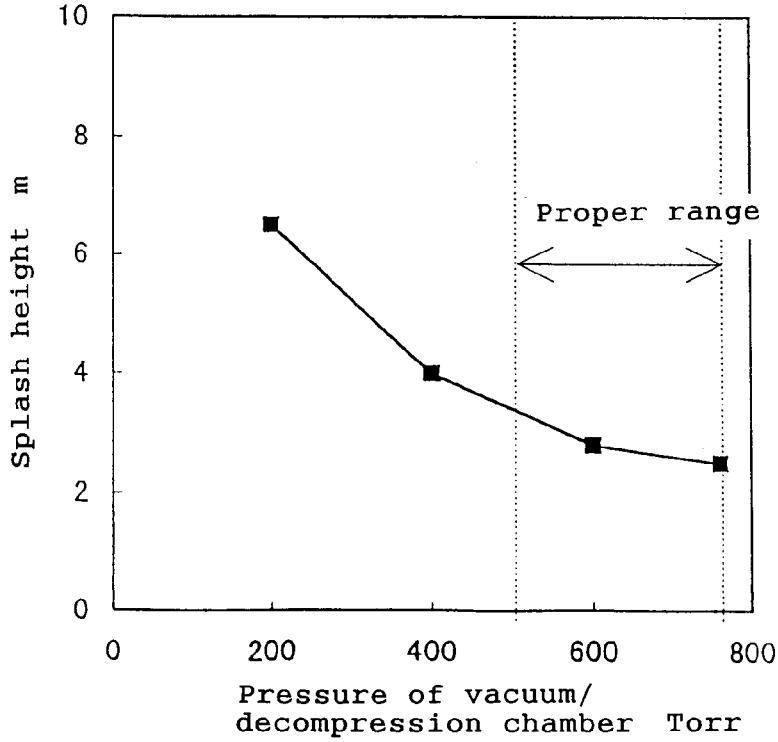
FIG. 7 is a graph showing a relationship between pressure in a vacuum/decompression chamber and height of steel splashes when oxygen is blown into molten steel containing Al in a case of using an apparatus according to the present invention.

FIG. 7 shows a relationship between pressure in the vacuum/decompression chamber and splash height during processing to bum Al in molten steel and heat the molten steel by supplying only oxygen to the molten steel through the heating burner when using the apparatus shown in FIG. 3. The splash height can be lowered and an amount of skull deposition in the vacuum/decompression chamber can be reduced, compared with the conventional RH process, by controlling pressure in the chamber to 500 Torr or higher.

Industrial Applicability

An apparatus according to the present invention and a refining method using the apparatus make it possible to: avoid adverse effects of molten steel splashing to a sealing joint of a ladle, which effects have constituted a problem of conventional ladle refining methods; decrease an amount of skull deposition in a vacuum/decompression chamber; and reduce a temperature drop of molten steel during processing. Further, with regard to production of a steel requiring high purity, the apparatus and the method make it possible to improve the efficiency of production processes by combining a process to lower an oxidizing capacity of slag and reform the slag and a degassing process in one refining facility.

What is claimed is:

1. A vacuum/decompression refining apparatus to refine molten steel, comprising:

a ladle adapted to contain molten steel, said ladle having a bottom and an upper portion defining an inner diameter;

a vacuum/decompression chamber having (i) a lower portion sealingly coupled to said upper portion of said ladle;

(ii) a top portion; and (iii) a shaft portion extending from said lower portion to said top portion, said shaft portion at a location adjacent to said lower portion of said vacuum/decompression chamber defining an inner diameter that is less than said inner diameter defined by said upper portion of said ladle; and an injection apparatus at said bottom of said ladle for injecting an inert gas into said ladle, such that when internal pressure within said vacuum/decompression chamber is reduced and molten steel contained within said ladle is agitated via injection of an inert gas into said ladle from said injection apparatus, a bulging portion of the molten steel is formed at a surface of the molten steel, wherein the bulging portion defines a diameter that is not larger than said inner diameter of said shaft portion.

2. The vacuum/decompression refining apparatus according to claim 1, wherein a height of said vacuum/decompression chamber is at least five meters such that when the molten steel is contained within said ladle a distance from the surface of the molten steel to said top portion of said vacuum/decompression chamber is at least five meters.

3. The vacuum/decompression refining apparatus according to claim 1, further comprising a cylindrical appendage extending from said lower portion of said vacuum/decompression chamber, said cylindrical appendage having (a) an inner diameter that is not less than the diameter defined by the bulging portion to be formed when the molten steel is contained within said ladle, and (b) an outer diameter that is not greater than the inner diameter defined by said upper portion of said ladle, wherein a lower end of said cylindrical appendage extends into said upper portion of said ladle but not into the molten steel when the molten steel is contained within said ladle.

4. The vacuum/decompression refining apparatus according to claim 3, further comprising a burner in said vacuum/decompression chamber adapted to burn fuel and oxygen and discharge a flame from a lower end of said burner.

5. The vacuum/decompression refining apparatus according to claim 1, further comprising a burner in said vacuum/decompression chamber adapted to burn fuel and oxygen and discharge a flame from a lower end of said burner.

6. The vacuum/decompression refining apparatus according to claim 1, wherein said vacuum/decompression chamber does not have at said lower portion an immersion tube that is to be immersed into molten steel contained within said ladle.

7. A ladle refining method using a vacuum/decompression refining apparatus including (i) a ladle having a bottom and an upper portion defining an inner diameter, (ii) a vacuum/decompression chamber having (a) a lower portion sealingly coupled to said upper portion of said ladle, (b) a top portion, and (c) a shaft portion extending from said lower portion to said top portion, said shaft portion at a location adjacent to said lower portion of said vacuum/decompression chamber defining an inner diameter that is less than said inner diameter defined by said upper portion of said ladle, and (iii) an injection apparatus at said bottom of said ladle for injecting an inert gas into said ladle said method comprising:

when molten steel is contained within said ladle, reducing internal pressure within said vacuum/decompression chamber and agitating said molten steel by injecting an inert gas into said ladle from said injection apparatus so as to form a bulging portion of said molten steel at a surface of said molten steel, with said bulging portion defining a diameter that is not larger than said inner diameter defined by said shaft portion.

8. The method according to claim 7, further comprising controlling an amount of slag on said surface of said molten steel contained within said ladle such that the following equation is realized $$0.010<H/h<0.025,$$

wherein H is a thickness of said slag and h is a depth of said molten steel.

9. The method according to claim 7, further comprising controlling pressure in said vacuum/decompression chamber to be from 760 to 500 Torr when heating said molten steel by adding aluminum to said molten steel and burning said aluminum by supplying oxygen thereto.

10. The method according to claim 7, wherein said vacuum/decompression apparatus further comprises a cylindrical appendage extending from said lower portion of said vacuum/decompression chamber into said upper portion of said ladle, said cylindrical appendage having an inner diameter and an outer diameter that is not greater than said inner diameter defined by said upper portion of said ladle, wherein when said molten steel is contained within said ladle, reducing said internal pressure within said vacuum/decompression chamber and agitating said molten steel by injecting said inert gas into said ladle forms said bulging portion at said surface of said molten steel such that said diameter defined by said bulging portion is not greater than said inner diameter of said cylindrical appendage and such that said cylindrical appendage does not extend into said molten steel.

11. The method according to claim 10, further comprising controlling an amount of slag on said surface of said molten steel contained within said ladle such that the following equation is realized $$0.010<H/h<0.025,$$

wherein H is a thickness of said slag and h is a depth of said molten steel.

12. The method according to claim 10, further comprising controlling pressure in said vacuum/decompression chamber to be from 760 to 500 Torr when heating said molten steel by adding aluminum to said molten steel and burning said aluminum by supplying oxygen thereto.

13. The method according to claim 10, further comprising using a burner in said vacuum/decompression chamber to burn fuel and oxygen so as to discharge a flame from a lower end of said burner.

14. The method according to claim 13, further comprising controlling an amount of slag on said surface of said molten steel contained within said ladle such that the following equation is realized $$0.010<H/h<0.025,$$

wherein H is a thickness of said slag and h is a depth of said molten steel.

15. The method according to claim 13, further comprising controlling pressure in said vacuum/decompression chamber to be from 760 to 500 Torr when heating said molten steel by adding aluminum to said molten steel and burning said aluminum by supplying oxygen thereto.

16. The method according to claim 13, further comprising using said flame discharged from said lower end of said burner to constantly maintain a temperature of an inner wall of said vacuum/decompression chamber to be at least 1,000° C.

17. The method according to claim 7, further comprising using a burner in said vacuum/decompression chamber to burn fuel and oxygen so as to discharge a flame from a lower end of said burner.

18. The method according to claim 17, further comprising controlling an amount of slag on said surface of said molten steel contained within said ladle such that the following equation is realized $$0.010<H/h<0.025,$$

wherein H is a thickness of said slag and h is a depth of said molten steel.

19. The method according to claim 17, further comprising controlling pressure in said vacuum/decompression chamber to be from 760 to 500 Torr when heating said molten steel by adding aluminum to said molten steel and burning said aluminum by supplying oxygen thereto.

20. The method according to claim 17, further comprising using said flame discharged from said lower end of said burner to constantly maintain a temperature of an inner wall of said vacuum/decompression chamber to be at least 1,000° C.

21. The vacuum/decompression refining apparatus according to claim 1, wherein said injection apparatus is centrally located at said bottom of said ladle.

22. The vacuum/decompression refining apparatus according to claim 21, wherein said injection apparatus is constructed and arranged at said bottom of said ladle so as to inject the inert gas into said ladle from an upper surface of said injection apparatus.

23. The vacuum/decompression refining apparatus according to claim 1, wherein said injection apparatus is constructed and arranged at said bottom of said ladle so as to inject the inert gas into said ladle from an upper surface of said injection apparatus.

24. The method according to claim 7, wherein said injection apparatus is centrally located at said bottom of said ladle such that injecting an inert gas into said ladle from said injection apparatus includes injecting said inert gas into said ladle from a central portion of said bottom of said ladle.

25. The method according to claim 24, wherein injecting said inert gas into said ladle from a central portion of said bottom of said ladle includes injecting said gas into said ladle from an upper surface of said injection apparatus.

26. The method according to claim 7, wherein injecting an inert gas into said ladle from said injection apparatus comprises injecting said inert gas into said ladle from an upper surface of said injection apparatus.

* * * * *